United States Patent [19]

Hargrove

[11] Patent Number: 4,761,838

[45] Date of Patent: Aug. 9, 1988

[54] CONTRAST-HEALING WATER SPA SYSTEM

[75] Inventor: John W. Hargrove, Houston, Tex.

[73] Assignee: Nancy A. Brown, Houston, Tex.

[21] Appl. No.: 46,834

[22] Filed: May 4, 1987

[51] Int. Cl.[4] ..... A61H 33/02

[52] U.S. Cl. ..... 4/542; 4/494; 4/514; 4/538; 128/66

[58] Field of Search ..... 4/541–545, 4/505, 514, 538, 539; 128/66

[56] References Cited

U.S. PATENT DOCUMENTS

| | | | |
|---|---|---|---|
| 3,455,299 | 7/1969 | Gerow | 128/66 |
| 3,460,166 | 8/1969 | Weber | 4/505 |
| 3,831,593 | 8/1974 | Ochoa | 4/541 |
| 3,943,580 | 3/1976 | Carter | 4/542 |
| 4,047,522 | 9/1977 | Plugge | 4/542 |
| 4,149,281 | 4/1979 | Bob et al. | 4/542 |
| 4,240,165 | 12/1980 | Kyrias | 4/505 |

*Primary Examiner*—Henry J. Recla
*Assistant Examiner*—L. J. Peters
*Attorney, Agent, or Firm*—Darryl M. Springs

[57] ABSTRACT

In one exemplar embodiment, a contrast-healing water spa system is disclosed that includes a single monolithically formed tub having two approximately equal-sized chambers that are separated by an integrally formed insulated structural wall that will provide hot aerated water in one cabinet and cold quiet water in the other chamber. A hot water circulating pump withdraws water from the hot water chamber at a predetermined flow rate, and the water is then passed through a filter and heater before being injected into the hot water chamber through high-pressure injection ports. A cold water circulating pump withdraws water from the cold water chamber at a predetermined flow rate, and the water is then passed through a filter and cooled by a sidestream mounted chiller before being returned to the cold water chamber. A single ozone generator is interconnected between the cold and hot water lines to add disinfectant to both water circulating systems. A cross-feed line and adjustable valve are disposed between the hot and cold water return lines after the ozone disinfectant is added to permit cross-feed of a selected quantity of hot water into the cold water system. A check valve is located in the cold water return line upstream of the cross-feed line to prevent hot water incursion upstream into the cold water circulating system.

19 Claims, 2 Drawing Sheets

CONTRAST-HEALING WATER SPA SYSTEM

BACKGROUND OF THE INVENTION

This invention relates to a combination "hot tub" or "hot water spa" and a "cool water tub" for enjoying the therapeutic benefits of hot and cold hydrotherapy. More particularly, the invention relates to a "contrast-healing" (hot/cold) water spa system that provides the contrasting hot and cold water in a single monolithically formed double-chambered equal volumes structure and with the chambers being separated by an integrally formed insulated structural wall.

Hot tubs which provide areated, agitated heated water for physical therapy or for relaxation have become popular in recent years and there is a large demand for such units because of the recognized beneficial import an users and the enjoyment value that it provides. Hot tubs have become so popular with certain socio-economic groups that the hot tub (in larger sizes) has become the focus for social events, such as "hot tub parties". However, many hot tub users share a common complaint, that they cannot stay in a hot tub very long without getting overheated and energy-drained. Hot tub parties don't last very long after everybody has gone into the tub once and became heated.

Solving the overheating problem is obvious: one can cool down by simply waiting, after leaving the hot tub, or by taking a cool shower or bath, or by jumping into a snowbank if available as the Finns have been doing for centuries. In some instances, a hot tub is built adjacent to or as part of a combination swimming pool/spa, where a large pool is built along with the spa (usually of on-site gunite construction), and the spa user can slip into the pool, if it's not too hot or too cold from ambient weather conditions. However, such a pool/spa combination requires a large space, is very expensive, and is beyond the reach of many individuals. Further, the temperature of the pool water (the cold water) is very dependent on the then current ambient temperature conditions and the volume of water available. Such pool/spa combinations require a large area to accommodate the conventional pool construction, and the pool water and hot tub generally operate from a single water handling and circulation system, with a portion of the "pool" water being diverted, heated and recirculated to the spa.

Accordingly, one primary feature of the present invention is to provide a contrast-healing water spa system that includes a single monolithically formed double-chambered tub having substantially equal volumes with the chambers separated by an integrally formed insulated structural wall.

Another feature of the present invention is to provide a contrast-healing water spa system that utilizes a dual chambered tub that is provided with water-jetted, areated hot water in one chamber and quiet, cool water in the other chamber.

Yet another feature of the present invention is to provide a contrast-healing water spa system in which each tub chamber has its own independent water circulation and temperature control system.

Another feature of the present invention is to provide a contrast-healing water spa system in which a single ozone generator is used to provide the disenfectant for treating the water in both chambers of the system.

Summary of the Invention

The present invention remedies the problems of the prior art by providing a contrast-healing spa system that includes a single tub monolithically formed into two approximately equal-sized chambers that will provide hot areated, water-jetted water to one chamber and cold quiet water to the other chamber. In accordance with one principle of the invention a contrast-healing water spa system is provided that comprises a monolithically formed double-chambered tub holding substantially equal volumes with the chambers separated by an integrally formed insulated structural wall, a hot water circulating means for withdrawing water from one of the tub chambers at a predetermined flow rate and heating the water to a preselected temperature before returning the water to the one tub chamber through a plurality of injection ports for agitating the hot water in the one tub chamber, a cold water circulating means for withdrawing from the other of the tub chambers at a predeterminded flow rate and chilling the water to a preselected temperature before returning the water to the other tub chamber while maintaining the cool water therein in a calm surface condition, disinfecting means cooperating with the hot and cold water circulating means for injecting a disinfectant into the hot and cold water circulating means after the water has been heated and chilled for disinfecting the heated and chilled water prior to return to the respective tub chambers and cross-feed means cooperating with the hot and cold water circulating means downstream of the disinfecting means for permitting cross-feed of heated water at a low preselected flow rate from the hot water circulating means into the cold water circulating means for heating the cold water prior to return to the other tub chamber for maintaining the water temperature within the other tub chamber at a preselected temperature.

In accordance with a further principle of the invention, wherein the hot water circulating means of the contrast-healing water spa system includes a first pump interconnected to a discharge outlet from the one tub chamber for withdrawing water therefrom at a predetermined flow rate, a first filter interconnected to the discharge outlet of the first pump receiving the withdrawn water and filtering particulate matter therefrom, a heater interconnected to the first filter outlet for receiving the discharged water from the one tub chamber and heating the water to a preselected temperature, and a hot water return line interconnected between the discharge outlet of the heater and a plurality of inlet ports disposed in the one tub chamber.

In accordance with a further principle of the invention, wherein the cold water circulating means of the contrast-healing water spa system includes a second pump interconnected to a discharge outlet from the other tub chamber for withdrawing water therefrom at a predetermined flow rate, a second filter interconnected to the discharge outlet of the second pump for receiving the withdrawn water and filtering particulate matter therefrom, a cold water return line interconnected between the discharge outlet of the second filter and an inlet port disposed in the tub chamber, and chilling means interconnected in the cold water return line between the second filter and the other tub chamber for chilling the water to a preselected temperature.

In accordance with yet another principle of the invention, wherein the chilling means of the contrast-healing water spa system comprises a low-flow rate water chiller having a flow rate substantially less than the flow rate of the second pump, the water chiller disposed offline from the cold water return line and interconnected thereto by a pair of spaced lines connected to the inlet and outlet ports of the water chiller, and a choke valve disposed in the cold water return line between the pair of water chiller lines, the choke valve adjustable to choke the flow rate of the water in the cold water return line to force a predetermined flow rate of water from the cold water return line through the water chiller line upstream of the choke valve into the inlet port of the water chiller.

In accordance with still another principle of the invention, wherein the cross-feed means of the contrast-healing water spa system comprises a cross-feed line interconnecting the hot and cold water return lines downstream of the heating and chilling means, an adjustable valve disposed in the cross-feed line for permitting a low preselected flow rate of heated water from the hot water return line to be delivered to the cold water return line for selectively heating the cold water delivered to the other tub chambers, and a check valve disposed in the cold water return line upstream of the cross-feed line connector to prevent the cross-fed heated water from backing up into the upstream portion of the cold water return line.

In accordance with another principle of the invention, wherein the disinfecting means of the contrast-healing water spa comprises an ozone generator the output of which is interconnected to both of the hot and cold water return lines heating and chilling means as above described; and wherein the systems further includes means for injecting pressurized air through a plurality of inlet ports into the hot water of the one tub chamber.

Brief Description of the Drawings

In order that the manner in which the above-recited advantages and features of the invention may be achieved and can be understood in detail, a more particular description of the invention may be had by reference to specific embodiments thereof which are illustrated in the accompanying drawings, which drawings form a part of this specification.

In the drawings.

DETAILED DESCRIPTION OF THE PREFERRED EMBODIMENTS

Figure 1:
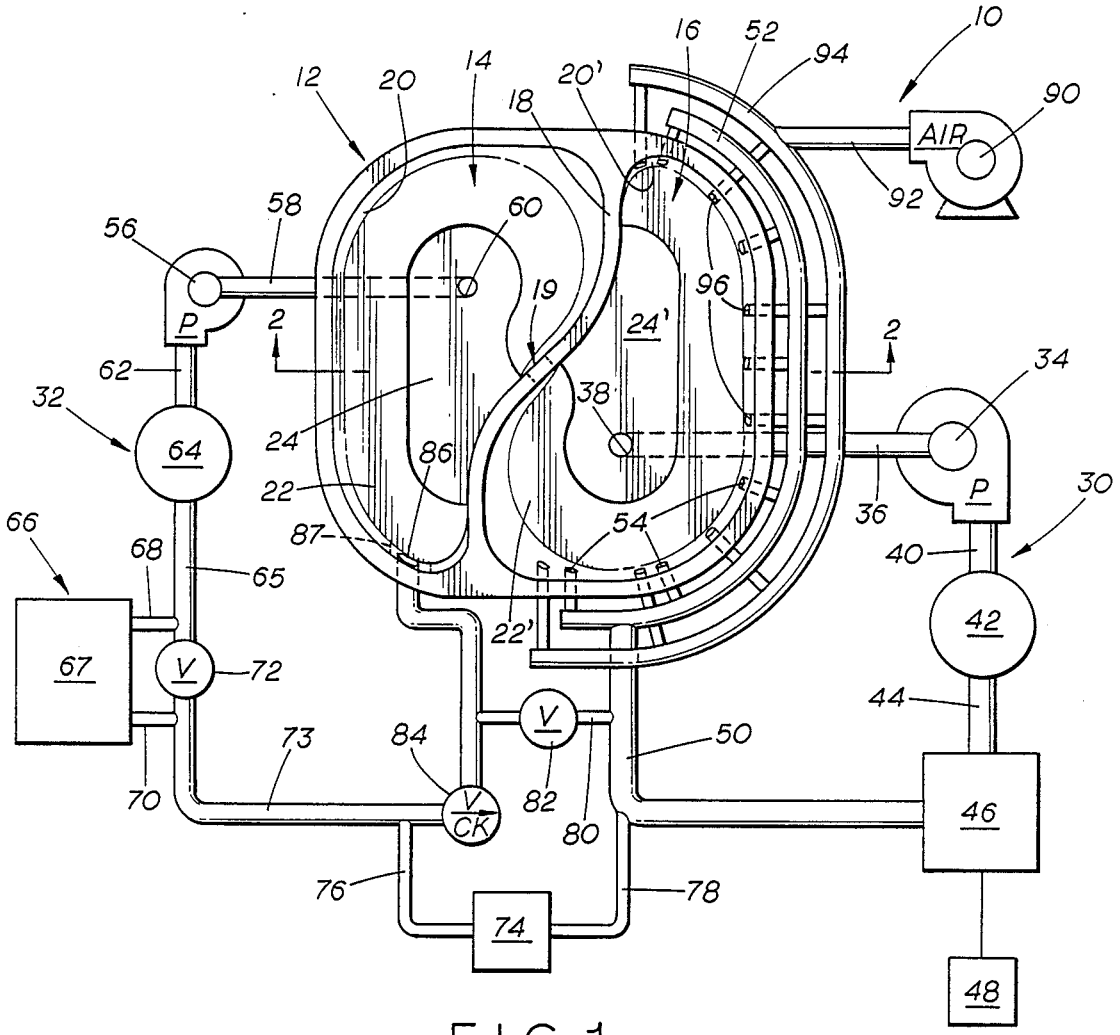
FIG. 1 is a schematic plan view of the contrast-healing water spa system according to this invention.
Figure 2:
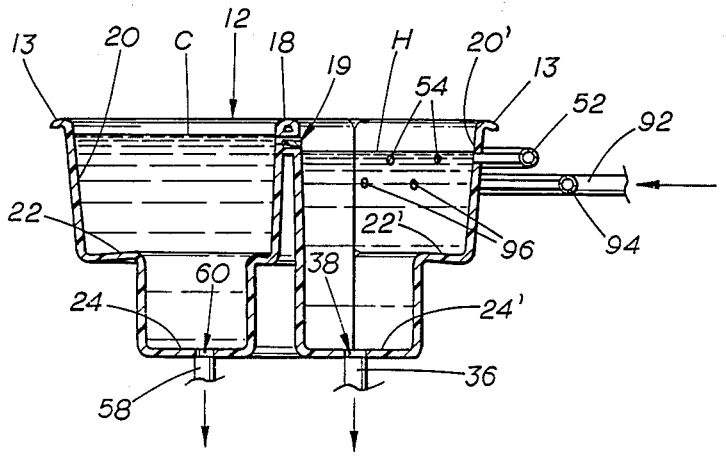
FIG. 2 is a vertical cross-sectional view of the dual-chambered tub as taken along lines 2—2 of FIG. 1.

Referring now to FIGS. 1 and 2, the contrast-healing water spa system 10 is shown, comprising a monolithically formed double-chambered tub 12 having substantially equal volume chambers 14 and 16, with the chambers separated by one integrally formed insulated structural wall 18. Disposed centrally of wall 18 is a one-way weir 19 for permitting cold water from chamber 14 to "overflow" into chamber 16 for reasons to be hereinafter described in greater detail. Each chamber 14 and 16 have an integral seating portion 22 and 22', respectively, with intgrally formed side wall portions 20 and 20', respectively, that slope up to the top edges of the tub 12 and along a portion of the structural wall 18. A floor portion 24 and 24' are disposed in each chamber 14 and 16, respectively, and are integrally formed with the seating and side wall portions 22 (22') and 20 (20'), respectively.

The tub 12 may be of any convenient configuration, round, square, rectangular or other regular geometric design that will lend itself to be divided into substantially equal chambers 14 and 16 by an integral structural wall 18. The tub may conveniently be constructed of any suitable material generally used in swimming pool and hot tub construction, such as fiberglass, acrylic or other combinations of artificial and/or synthetic materials. It has been found convenient for the tub 12 to have a size approximately equivalent to a circle having a 6 to 12 foot diameter and providing dual chambers each having a capacity of 200 to 1000 gallons.

Each chamber 14 and 16 has associated therewith its own independent water circulating system 32 and 30, respectively. In the discussion which follows, the chamber 14 will be described as the chamber containing the cold water, while the chamber 16 will be described as the chamber containing the hot water, and thus the independent water circulating system or means 30 will be referred to as the hot water circulating means or system, while the independent water circulating system or means 32 will be referred to as the cold water circulating means or system. The hot water circulating system 30 withdraws water from chamber 16 through a drain port 38, located in the floor section 24', at a predetermined flow rate, filters the water for particulate matter and heats the water to a preselected temperature before returning the water to tub chamber 16 through a plurality of injection ports 54 for acting as water jets for agitating the hot water in tub chamber 16. The cold water circulating system 32 withdraws water from chamber 16 through a drain 60, located in the floor section 24, at a predetermined flow rate, filters the water for particulate matter and chills the water to a preselected temperature before returning the water to tub chamber 14 through an inlet port 86. A deflector 87 may be used in connection with inlet port 86 to deflect and spread the inlet water stream from the cold water circulating system 32 in order to maintain the surface of the cold water in chamber 14 in a calm unagitated condition.

The hot water circulating system 30 includes a high pressure, high capacity water pump 34 for withdrawing water from chamber 16 through drain outlet 38 and pipe 36 and discharges the water under pressure through pipe 40 to the inlet port of a conventional large capacity filter unit 42 that filters out sediment and particulate matter from the hot water stream. The filtered water is applied through the outlet port of filter 42 through a pipe 44 to a conventional spa or swimming pool heater 46. Heater 46 is usually operated by gas from an outside gas line (not shown) and controlled by a thermostat 48 for heating the water therein to a preselected temperature. The pressurized, heated water is discharged from heater 46 through a hot water return line 50 and a hot water header unit 52 for injection into the tub chamber 16 through the plurality of water jet or nozzle ports 54 to agitate the hot water in chamber 16.

For the range of tub sizes hereinabove described, the pump 34 may conveniently be a conventional spa or swimming pool water pump on the order of a two-horsepower unit or less that delivers the water at a flow rate of 30 to 120 gallons per minute, and withdraws the water from tub chamber 16 through suction pipe 36 that preferably has a diameter of 2 or 3 inches to accommodate the high flow rate. The filter 42 is a conventional spa type filter sized to accommodate the maximum flow rate of pump 34.

The cold water circulating system 32 includes a low pressure, low capacity water pump 56 for withdrawing water from tub chamber 14 through a suction pipe 58 through a drain outlet 60 and discharging the water under pressure through a pipe section 62 to a conventional small capacity filter 64 for filtering out sediment and particulate matter from the low pressure cold water stream. The outlet port of the filter 64 is connected by a pipe section 65 to an off-line water chilling means 66. The water chilling means comprises a choke valve 72 disposed between pipe section 65 and the cold water return line 72 and a low flow rate water chilling unit 67, the inlet port of which is connected up stream of choke valve 72 by means of a line 68 and the outlet port of which is connected downstream of the choke valve 72 through a line 70. The choke valve 72 is adjusted to choke the cold water return line 72 to create a pressure drop across the valve that is sufficient to divert or "bleed-feed" some of the water in pipe section 65 upstream of choke valve 72 through line 68 through the chilling unit 67. The low flow rate chilled water is returned to the main cold water stream through line 70. The chilled water from the chiller unit 67 and the cold water passing through choke valve 72 are mixed and applied through the cold water return line 72 through inlet port 86 under low pressure.

Again, as in the hot water circulating system, for the range of tub sizes hereinabove described, the pump 56 is conveniently a conventional spa or swimming pool water pump on the order of a 0.5 horsepower unit that delivers the water at a flow rate of 10 to 30 gallons per minute, and withdraws the water from tub chamber 14 through a suction pipe 58 that preferably has a diameter of about 1½ or 2 inches for accommodating the low flow rate of the cold water circulating system. The filter 64 is a conventional spa type filter sized to accommodate the maximum flow rate of pump 56.

The water chilling unit 67 is a conventional drinking fountain type remote water cooler having a very low maximum flow-through rate of approximately 20 gallons per hour or about one-third (⅓) gallons per minute. Since the capacity of pump 56 is substantially greater than this flow rate, the off-line mounting of the chiller unit 67 and the utilization of the choke valve 72 overcomes the low flow-through rate of the chiller unit. The chiller unit 67 could not be inserted directly into the cold water return line 72 because the closed-circulation system of the cold water circulation system requires at least 600 gallons per hour flow-through to maintain adequate disinfection of the water as will be hereinafter described in greater detail.

The selection of a chilling unit, such as unit 67, was based on the necessity to maintain the water in chamber 14 at a nominal 75° F., plus or minus 10° F. The use of ice would be one way to solve the problem, but it would require constant user attention and almost continuous interaction with the system with no real procedure to maintain the water temperature constant. Without ice or a chiller, the only other workable way to provide a hot/cool spa system would require a large body of relatively cooler water, like a swimming pool. The body of water would have to be large enough to act as a heat sink with little rise in temperature during spa use. But, as hereinabove mentioned, the expense of such a system limits its availability to individuals.

Thermal calorimetry calculations have demonstrated that a small chiller unit of 1000 to 2000 BTU/hour heat removal capacity will handle all heat loads that 4 to 12 users might impose over a 2 hour period, with less than a 2° F. temperature rise, for a tub size approximately equivalent to a circle having a diameter of 10–12 feet.

A small chiller unit 67 of this size will require 15 minutes or less run time per day to maintain 75° F. on the cool side while 80° F. is being maintained on the hot side when the tub 12 is covered. Should the hot side be maintained at 90° F., the chiller will need to run 45 minutes per day to maintain 75° F.

The small chiller 67 does this by chilling water at a small flow rate of 20 gallons per hour, plus or minus, to 50° F. The amount of heat required to raise 15 minutes of supply water at this rate and temperature is approximately equal to the amount of heat calculated to cross the divider wall 18 from 80° F. water (hot water chamber 16) to 75° F. water (cold water chamber 14) in a 24-hour period.

For four persons using the tub 12, the chiller is also able to maintain almost indefinitely 75° F. water with each user re-entering the cool chamber 14 from the hot chamber 16 once every 20 minutes, with the hot chamber at 100° F., and assuming each user at 175 pounds, overheated to 99° F., plus. If we allow a small 2° F. rise in temperature in the cool chamber, the 2000 BTU/hour chiller 67 can accommodate as many as 12 users in a 10-foot equivalent diameter contrast-healing spa tub 12.

The cold water return line 72 delivers the cold water to chamber 14 through a relatively large (approximately 4 inches) inlet port 86, and, cooperating with a deflector 87 which deflects and spreads the inlet stream of cold water, insures maintenance of a quiet and calm cool water surface which greatly contributes to the contrast-healing spa experience.

As may be seen in FIG. 1, the disinfecting means 74 is preferably an ozone generator that supplies ozone as a disinfectant to both the hot water return line 50 through line 78 and the cold water return line 72 through line 76. In this way, the hot and cold water circulation systems 30 and 32 may remain independent in circulation and operation, but have a common means of disinfecting the water used in both systems. Ozone is preferred as a disinfectant because it is cheaper and safer to handle than chlorine, which also may combine with certain organic materials to cause health endangering chemical combinations.

The water circulation systems 30 and 32 may also include the cross-feed means interconnecting the hot water and cold water return lines 50 and 72, respectively, down stream of the heater unit 46 and the water chiller 67 and further downstream of the ozone generator disinfectant unit 74, and comprises an adjustable valve 82 disposed in a cross-feed line 80 interconnecting lines 50 and 72, and a check valve 84 mounted in the cold water return line 72 upstream of the cross-feed line 80. The cross-feed arrangement is utilized, primarily in cold weather, by opening and adjusting valve 82 to deliver hot water from return line 50 at a low rate (on the order of 2–10 gallons per hour) to the cold water return line 72 at selected times to raise and maintain the water temperature in the cold water chamber 14 at approximately 75° F. during weather when the ambient outdoor temperature is below 75° F. In such cases, a small one-way weir 19 in the tub divider wall (see FIGS. 4, 5 and 6) permits cool water to overflow from the cold water chamber 14 to the hot water chamber 16. The check valve 84 prevents the heated water from return line 50 from backing up into the upstream portion of the cold water return line 72 and into the cold water circulation system 32.

Figure 3:
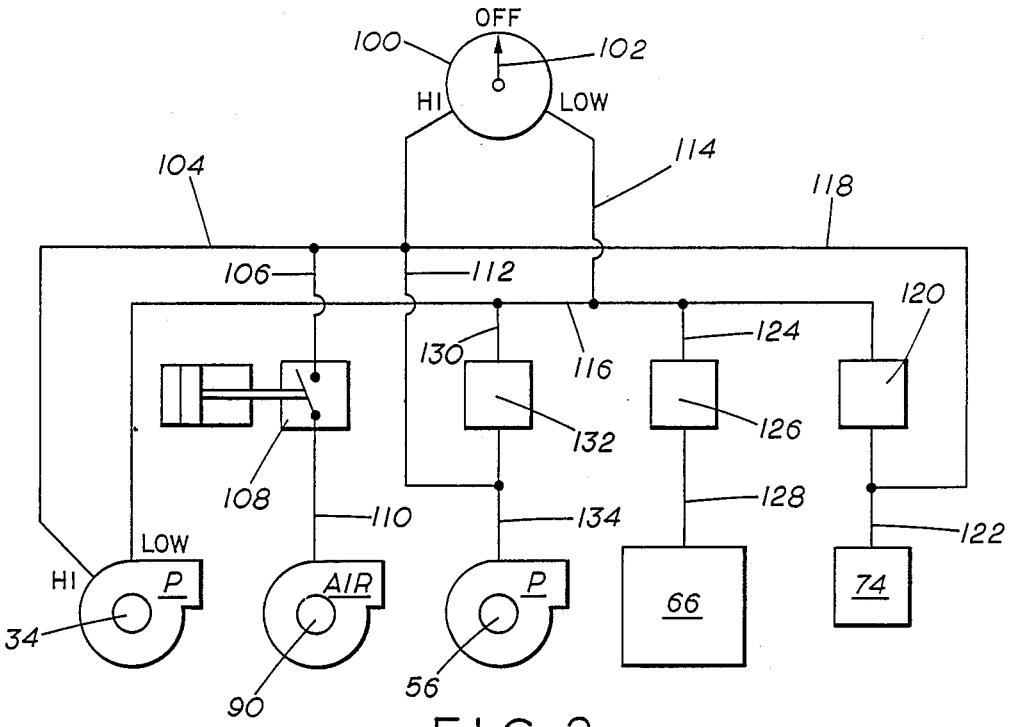
FIG. 3 is a schematic of one embodiment of the electrical control circuit for the contrast-healing water spa system.

Referring now to FIG. 3, a basic control schemata for the contrast-healing spa system is shown. A remotely located switch 100 may have OFF, LOW and HIGH switch settings. By positioning the switch 100 lever 102 to the "low" position, operating electrical power is applied via conductors 114 and 116 to energize a two-speed high capacity, high-pressure pump 34 in its low operating range; via conductors 114, 116 and 130 to a timer 132 that energizes the low capacity pump 56 through conductor 134; via conductors 114, 116 and 124 to a thermostat 126 that will energize the water chiller 66 via conductor 128; and through conductors 114 and 116 to a timer 120 that energizes the ozone generator 74 via conductor 122. The pump 56 and the ozone generator disinfectant unit 74 operate in response to the timers 132 and 120, respectively.

If the switch lever 102 is set to the "high" position, electrical power is applied via conductor 104 to the pump 34 to energize it in its high operating range; via conductors 104, 112 and 134 to by-pass timer 132 and energize directly the low capacity, low pressure pump 56; via conductors 104, 112 and 118 to by-pass timer 120 for energizing directly the ozone generator 74. In the "high" operating range, the hot water circulation pump 34 is operating in the high end of its operating range, the cold water circulation pump 56 is operating continuously, and the ozone generator disinfectant means 74 is also operating continuously. Electrical power from switch 100 is also applied via conductors 104 and 106 to one side of an air actuated switch 108 (similar to the type of "on switch" powered with aquarium pumps), which is preferably located adjacent the hot chamber 16 of tub 12, for energizing the air blower 90 via conductor 110. The air blower 90 delivers pressurized air, as hereinabove described through outlet pipe 92 to a distribution header 94 and thence via nozzles 96 into the tub chamber 16 for adding to the water agitation of the hot tub chamber 16.

Figure 4:
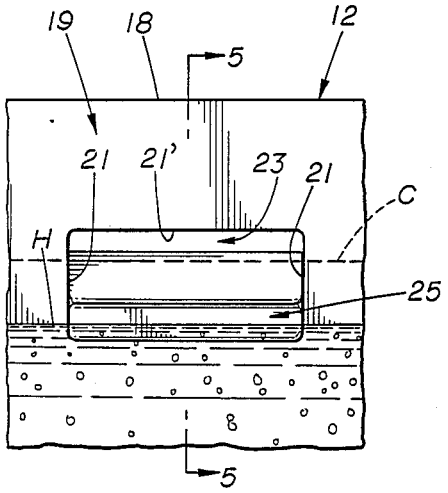
FIG. 4 is fragmentary view of a protion of the wall separating the two tub chambers, showing the weir disposed therein.
Figure 5:
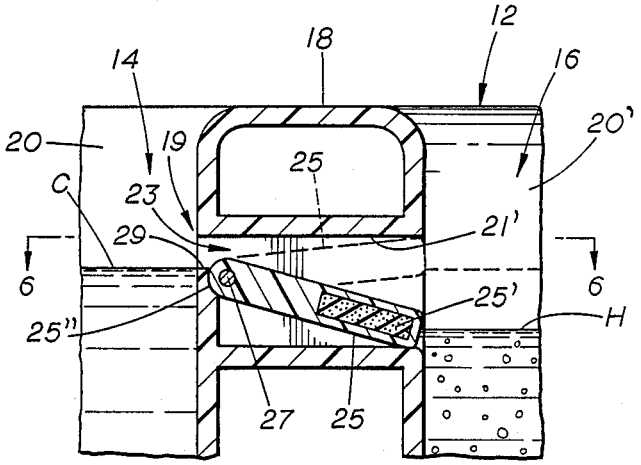
FIG. 5 is a vertical cross-sectional view of the portion of the wall separating the two tub chambers through the weir as taken along lines 5—5 of FIG. 4.
Figure 6:
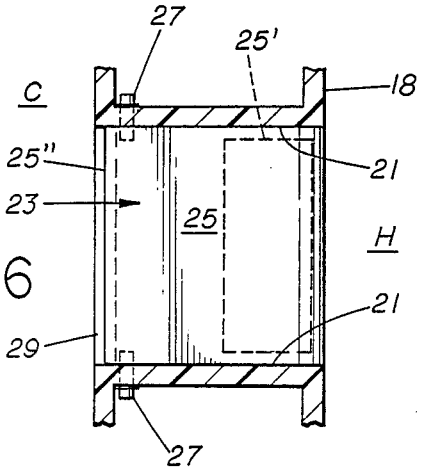
FIG. 6 is a horizontal cross-sectional view of the wall and the weir float as taken along lines 6—6 of FIG. 5.

Referring now to FIGS. 4, 5 and 6, the small one-way weir 19, disposed in the integral structural wall 18 separating the dual tub chambers 14 and 16. In the circumstance described above where the hot water cross-feed is utilized in cold weather to "warm" and maintain the "cool" water at a selected water temperature of approximately 75° F., the water level C in the "cold" water chamber 14 may rise appreciably above the hot awter level H in the hot water chamber 16 due to the increase in water supplied to the cold water circulation system. The one-way weir 19 has a hinged flap 25 disposed in a rectangular opening 23 formed in the dividing wall 18 and framed by sides 21 and 21'. The flap 25 may conveniently be a conventional "skimmer float" used in pools having an enlarged free end 25' facing the hot water side 16 and a narrower end 25'' that is pinned between the opening sides 21 adjacent the cold water side 14 by means of a pin or rod 27. The enlarged end 25' contains a light foamed plastic therein, such as Styrofoam, and is encapsulated in a yieldable plastic that will tend to "seal" against the upper edge 21'. As long as the water level "H" in chamber 16 is below the level of the bottom of the weir opening in the dividing wall 18, the free end 25' of the flap 25 will be in the "lowered" or "down" position. Therefore, if the water level "C" in chamber 14 rises above the lower edge 29 of the opening 23 on the cold water side, the cold water will overflow through the weir opening 23 from the cold water side 14 to the hot water side 16. On the other hand, if the hot water level in chamber 16 rises above the lower edge of the weir opening on the hot water side, the float 25 will "float" with the hot water level, and if the hot water level rises enough, the float 25 will contact the upper surface 21' of the weir opening and "seal" the "opening" 23, thus preventing overflow of the hot water from chamber 16 to the cold water chamber 14. Accordingly, the weir 19 acts to control overflow between the tub chambers to only one direction, namely, from the cold to the hot water chamber, and prevents flow in the opposite direction.

I claim:

1. A contrast-healing water spa system comprising a monolithically formed double-chambered tub having substantially equal volumes, said chambers separated by an integrally formed insulated structural wall, an independent hot water circulating means for withdrawing water from one of said tub chambers at a first predetermined flow rate and heating the water to a preselected temperature before returning the water to said one tub chamber through a plurality of injection ports for agitating the hot water in said one tub chamber, an independent cold water circulating means for withdrawing water from the other of said tub chambers at a second predetermined flow rate and chilling the water to a preselected temperature before returning the water to said other tub chamber and deflecting the inlet stream of water for maintaining the cool water in a calm surface condition in said other tub chamber, disinfecting means cooperating with said hot and cold water circulating means for injecting a disinfectant into said hot and cold water circulating means after the water has been heated and chilled for disinfecting said heated and chilled water prior to return to said respective tub chambers, and cross-feed means cooperating with said hot and cold water circulating means downstream of said disinfecting means for permitting cross-feed of heated water at a low pre-selected flow rate from said hot water circulating means into said cold water circulating means for heating the chilled water prior to return to the other tub chamber for maintaining the water temperature within the other tub chamber at a preselected temperature.

2. The contrast-heating water spa system as described in claim 1, wherein said hot water circulating means comprises a first pump interconnected to a discharge outlet from said one tub chamber for withdrawing water therefrom at a first predetermined flow rate, a first filter interconnected to the discharge outlet of said first pump for receiving said withdrawn water and filtering particulate matter therefrom, a heater interconnected to said first filter outlet for receiving said discharged water from said one tub chamber and heating said water to a preselected temperature, and a hot water return line interconnected between the discharge outlet of said heater and a plurality of inlet ports disposed in said one tub chamber.

3. The contrast-healing water spa system as described in claim 1, wherein said cold water circulating means comprises a second pump interconnected to a discharge outlet from said other tub chamber for withdrawing water therefrom at a second predetermined flow rate, a second filter interconnected to the discharge outlet of said second pump for receiving said withdrawn water and filtering particulate matter therefrom, a cold water return line interconnected between the discharge outlet of said second filter and an inlet port disposed in said other tub chamber, and chilling means interconnected in said cold water return line between said second filter and said other tub chamber for chilling said water to a preselected temperature.

4. The contrast-healing water spa system as described in claim 3, wherein said chilling means comprises a low flow rate water chiller having a flow rate substantially less than the flow rate of said second pump, said water chiller disposed off-line from said cold water return line and interconnected thereto by a pair of spaced lines connected to the inlet and outlet ports of said water chiller, and a choke valve disposed in said cold water return line between said pair of water chiller lines, said choke valve adjustable to choke the flow rate of the water in said cold water return line to force a predetermined flow rate of water from said cold water return line through said water chiller line upstream of said choke valve into the inlet port of said water chiller.

5. The contrast healing water spa system as described in claim 4, wherein flow rate of said low flow rate water chiller is less than 1 gallon per minute.

6. The contrast healing water spa system as described in claim 5, wherein said low preselected flow rate through said cross-feed line valve is in the range of 2 to 10 gallons per hour.

7. The contrast-healing water spa system as described in claim 3, wherein said disinfecting means comprises an ozone generator, the output of which is interconnected to both said hot and cold water return lines downstream of said heating and chilling means.

8. The contrast-healing water spa system as described in claim 3, wherein said cross-feed means comprises a cross-feed line interconnecting said hot and cold water return lines downstream of said heating and chilling means, an adjustable valve disposed in said cross-feed line for permitting a low preselected flow rate of heated water from said hot water return line to be delivered to said cold water return line for selectively heating the cold water delivered to said other tub chamber, and a check valve disposed in said cold water return line upstream of said cross-feed line connection to prevent the cross-fed heated water from backing up into the upstream portion of said cold water return line.

9. The contrast healing water spa system as described in claim 8, wherein said low preselected flow rate of said heated water through said cross-feed line valve into said cold water return line is selected to maintain the cool water in the other tub chamber at approximately 65° F. to 85° F.

10. The contrast healing water spa system as described in claim 1, wherein said second pre-determined flow rate of water withdrawn from said other tub chamber is in the range of 10 to 30 gallons per minute.

11. The contrast healing water spa system as described in claim 1, wherein said preselected temperature of said heated water is in the range of 80° F. to 110° F.

12. The contrast healing water spa system as described in claim 1, wherein said preselected temperature of said chilled water is in the range of 65° F. to 85° F.

13. The contrast healing water spa system as described in claim 1, wherein said first predetermined flow rate of water withdrawal from said one tub chamber is in the range of 30 to 120 gallons per minute.

14. The contrast healing water spa system as described in claim 1, further including means for injecting pressurized air through a plurality of inlet ports into the hot water of said one tub chamber.

15. The contrast-heating water spa system as described in claim 1, further including a deflector mounted adjacent the inlet port disposed in said other tub chamber for deflecting the cold water returned thereto to maintain the surface of the cold water in a substantially calm condition.

16. The contrast healing water spa system as described in claim 1, wherein said double chambered tub is sized to approximate a circular tub having a diameter in the range of 6 to 12 feet.

17. The contrast-healing water spa as described in claim 1, further including weir means disposed centrally of said integrally formed structurally dividing wall for permitting one-way overflow of cold water from said other of said chambers into the one chamber containing the hot water.

18. The contrast-healing water spa as described in claim 17, wherein each of said tub chambers has a volume in the range of 200 to 1000 gallons.

19. The contrast-healing water spa as described in claim 17, wherein said weir means comprises an elongated floatable member disposed in a rectangular opening disposed centrally of said structural wall and spaced closely adjacent the top of said wall, said floatable member having one end mounted within said opening adjacent said cold water chamber for permitting said floatable member free end limited accurate movement adjacent said hot water chamber, and pins mounting said one end of said float in the opening side walls adjacent said cold water chamber, wherein as long as said water level in said hot water chamber is below the level of said free end of said floatable member, water from said cold water chamber is free to overflow into said hot water chamber if the cold water level rises above the weir opening in said cold water chamber, but as said water in said hot water chamber rises above the level of said free end of said floatable member, said free end of said floatable member will float with said hot water level until said float free end engages the top of said weir opening for sealing said opening and substantially preventing hot water overflow through said weir opening from said hot water chamber to said cold water chamber.

* * * * *